United States Patent [19]

Ogura et al.

[11] 4,413,484

[45] Nov. 8, 1983

[54] BASKET GOAL NET

[75] Inventors: Hiroyuki Ogura, Kyoto; Toyoyuki Kuroda, Kuwana, both of Japan

[73] Assignee: Raschel Co., Ltd., Japan

[21] Appl. No.: 284,093

[22] Filed: Jul. 16, 1981

[30] Foreign Application Priority Data

| | | | |
|---|---|---|---|
| Jul. 28, 1980 | [JP] | Japan | 55-107431[U] |
| Jul. 28, 1980 | [JP] | Japan | 55-107432[U] |
| Nov. 19, 1980 | [JP] | Japan | 55-163493 |
| Mar. 19, 1981 | [JP] | Japan | 56-039885 |

[51] Int. Cl.[3] ..... D04B 23/08

[52] U.S. Cl. ..... 66/193

[58] Field of Search ..... 66/190, 192, 195, 202

[56] References Cited

U.S. PATENT DOCUMENTS

| | | | |
|---|---|---|---|
| 3,118,294 | 1/1964 | Van Laethem | 66/193 |
| 3,171,272 | 3/1965 | Frith | 66/195 |
| 3,242,699 | 3/1966 | Momoi | 66/193 |

*Primary Examiner*—Ronald Feldbaum

*Attorney, Agent, or Firm*—Barnes, Kisselle, Raisch, Choate, Whittemore & Hulbert

[57] ABSTRACT

A basket goal net characterized in that the net is formed from a plurality of netting cords of synthetic fiber, each of the netting cords comprising at least one chain yarn knitted on a Raschel machine and at least one inlay yarn, each two adjacent netting cords being joined together at a plurality of locations by Raschel knitting. The net has none of the sheet bends or like knots included in conventional goal nets and is therefore highly resistant to abrasion. Since the legs of the junctions of the netting cords will not be fully stretched, the net retains sufficient restoring proporties at all times, permitting the ball to pass therethrough at a reduced speed so that the passage of the ball can be recognized manifestly. When the cords are warp-knitted into an ingenious structure, the net has high anti-whipping properties. When further heat-treated, the net can be given perfect abrasion resistance, restoring properties and anti-whipping properties.

8 Claims, 5 Drawing Figures

BASKET GOAL NET

The present invention relates to a basket goal net, and more particularly to a basket goal net which has high durability and anti-whipping properties and which permits the basket ball to pass therethrough as desired in such manner that the passage of the ball can be recognized easily.

Generally basket goal nets must have the following essential characteristics.

1. Abrasion resistance
2. Restoring properties, i.e. the properties which permit the ball to pass through the net at a temporarily reduced speed so that the passage of the ball will be recognized easily while enabling the net to restore itself by contraction upon the passage of the ball through the net.
3. Anti-whipping properties, i.e. the properties which prevent the net from whipping up and twining about the ring upon passage of the ball due to the resulting reaction to avoid trouble to the game.

Basket goal nets are usually formed from spun yarns of short nylon and vinylon fibers by manually knotting the yarns to make sheet bends (English knots) which are arranged laterally. The materials chiefly used for this method are nylon spun yarns having a thickness of 4 mm or 6 mm and vinylon spun yarns having a thickness of 20s/180. Conventional baskets formed from such materials invariably have large knots, which are subject to abrasion every time the ball passes through the basket. The abrasion of the knots reduces the strength of the net and eventually leads to a break, hence very low durability.

When the ball passes through the conventional goal net once, the knots are firmly fastened and the legs of the knots are stretched. This totally eliminates the restoring properties of the net and greatly deforms meshes. When the ball passes through the net again, the ball passing portion of the net, which has been fully enlarged, fails to slow down the ball, allowing the ball to pass therethrough quickly. During games, therefore, it is difficult for the judge to recognize whether or not the ball has passed through the goal net.

The basket goal nets specified for use in official games are those subjected to so-called anti-whipping treatment which hardens the upper portion of the net with resin. This treatment serves to avoid the trouble that would result if the net whips and twines about the ring due to the reaction of the ball thrown through the net.

The anti-whipping treatment is conducted usually by immersing the upper portion of the goal net in a solution of hard resin in a solvent, withdrawing the net and drying the net in air or by a hot air dryer. This method is very inefficient, while the evaporation of the solvent is liable to alter the resin concentration of the solution during treatment for commercial production, presenting difficulty in affording the product with a uniform quality. The treatment has another drawback in that the use of the solvent could impair the working environment.

As already described, conventional basket goal nets are formed from spun yarns of nylon and vinylon by manually making sheet bends. This method of production requires a special process for preparing very thick spun yarns by spinning short nylon and vinylon fibers. Additionally, since it is difficult to knit such thick spun yarns by a machine, the manual method is needed which is extremely inefficient. Due to the increase of the labor cost, the manufacturing cost rises year after year, rendering the product more expensive. Thus conventional basket goal nets have various drawbacks including difficulties encountered in simplifying the process and improving the productivity. It has therefore been desired to provide a basket goal net which has improved characteristics and which can be manufactured inexpensively without resorting to the conventional process.

An object of the present invention, which has been accomplished in view of the foregoing problems, is to provide a basket goal net which is outstanding in durability and restoring properties and permits the basket ball to pass therethrough as desired and which can be manufactured inexpensively although having a high quality.

To fulfill this object, the invention provides a basket goal net characterized in that the net is formed from a plurality of netting cords of synthetic fiber, each of the netting cords comprising at least one chain yarn knitted on a Raschel machine and at least one inlay yarn, each two adjacent netting cords being joined together at a plurality of locations by Raschel knitting.

With the structure described above, the netting cords are joined together by Raschel knitting, so that the net has no sheet bend or other knot unlike the conventional product. This serves to greatly reduce the abrasion due to the passage of the ball to assure a prolonged life. The net retains restoring properties at all times because it does not have the drawback that that passage of the ball fully stretches the legs of sheet bends (owing to the tightening of the knots).

Another object of the invention is to provide a net having satisfactory anti-whipping properties without resorting to the treatment with resin.

To fulfill this object, loops are formed by Raschel knitting also from the inlay yarn of each netting yarn at least in the upper half of the goal net.

The loops of the inlay yarn give a correspondingly increased thickness, i.e. enhanced stiffness, to the upper half portion of the netting cord, consequently imparting improved anti-whipping properties to the goal net.

Another object of the invention is to provide a goal net having further improved anti-whipping properties and therefore almost ideal quality.

This object can be attained by heat-treating the goal net described to give an increased density to the netting cords and thereby impart stiffness thereto.

Various features and advantages of the present invention will become apparent from the following embodiments described with reference to the accompanying drawings, in which.

Figure 5:
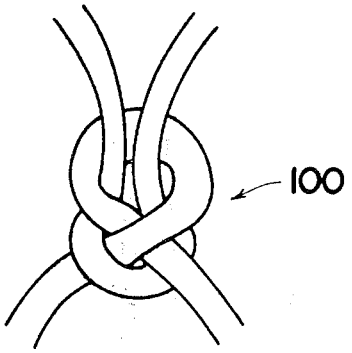
FIG. 5 is a view showing a sheet bend of a conventional net.

Before the description of embodiments of the present invention, a conventional goal net will be described with reference to FIG. 5. The conventional net is formed from spun yarns of short nylon and vinylon fibers usually by manually knotting the yarns zigzag in a horizontal direction to make sheet bends 100. As will be apparent from the drawing, the knot 100 is invariably large, with the result that the ball, when passing through the net, markedly wears the portions of knots 100. The net is therefore very susceptible to a break. Further when the ball is thrown through the net several times, the knot 100 becomes compacted by tightening to stretch its legs greatly. Thus the net has the drawback of rapidly losing the restoring properties essential to the net. This invention has been accomplished to eliminate these drawbacks. An embodiment of the invention will now be described with reference to FIGS. 1 to 3.

Figure 3:
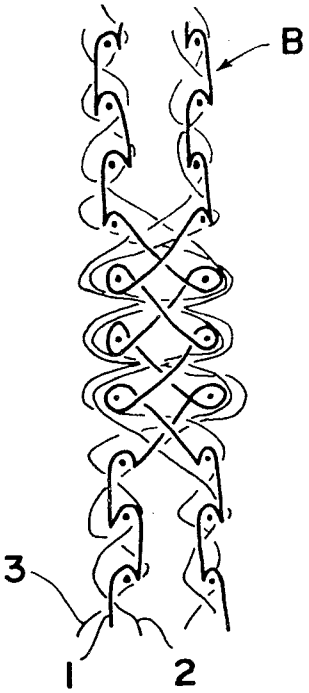
FIG. 3 is a diagram of a network in which the junctions are composed of three courses.
Figure 2:
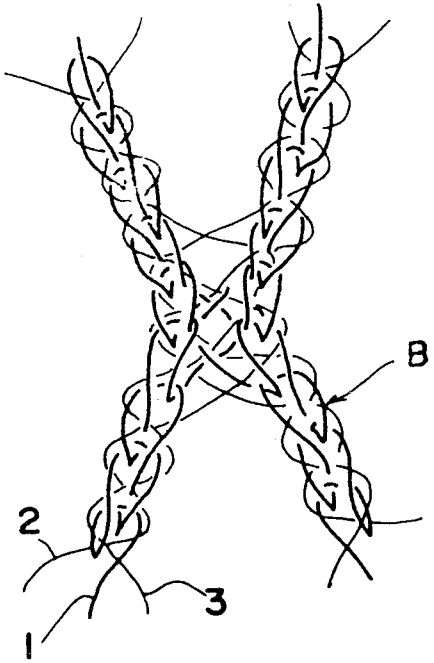
FIG. 2 is an enlarged view showing a portion A of FIG. 1.
Figure 1:
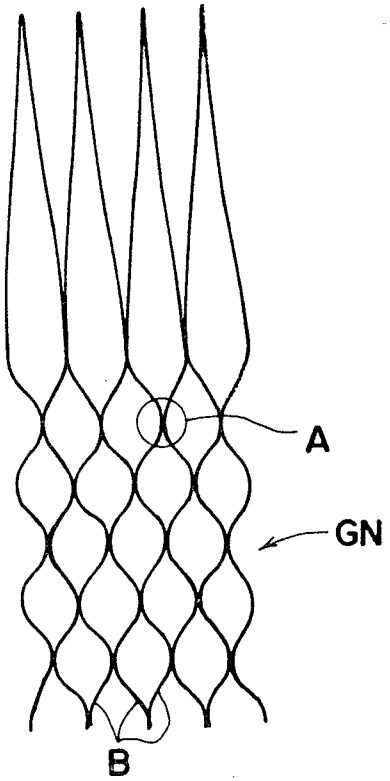
FIG. 1 is a view showing the network structure of a basket goal net embodying the invention.

The illustrated basket goal net GN according to the invention is knitted of a plurality of netting cords B which are formed from polyester, polyamide, polyethylene, polypropylene or like synthetic fiber yarns by Raschel knitting and has meshes resembling honeycombs (FIG. 1). As seen in FIG. 2, each of the netting cords B comprises a chain yarn 1 knitted on a Raschel machine and two kinds of inlay yarns 2, 3. One of the inlay yarns can be dispensed with. The netting cords have a thickness of 1.5 mm to 10 mm. The number of courses forming the junctions between two adjacent netting cords is dependent on the restoring properties required of the goal net. When high restoring properties are desirable, the junction is provided by three courses as shown in FIG. 3 or by a larger number of courses.

When the combined thickness of the chain yarn 1 and inlay yarns 2, 3, i.e. the thickness of the netting cord B, is less than 1.5 mm, the net has inferior abrasion resistance and low strength. Further if the netting cord is thinner, the net will have higher flexibility, with the resulting likelihood that the net will whip up and twine about the ring due to the reaction of the ball thrown through the net. On the other hand, when the thickness of the netting cord B exceeds 10 mm, the net has increased abrasion resistance and enhanced strength but possesses exceedingly low flexibility, failing to pass the ball smoothly.

Directing special attention to this point, we prepared various goal nets from netting cords of different thicknesses and tested the nets for the amenability to the passage of the ball and for the restoring properties, etc. thereof upon the passage of the ball. The test revealed that netting cords having a thickness of 1.5 mm to 10 mm achieve good results.

Examples of useful yarns of synthetic fiber are multifilament, monofilament, tape yarn, split yarn, etc. Greatly improved abrasion resistance is available especially by using monofilaments of up to 1,100 denier, and tape yarns and split yarns of up to 30,000 denier. These yarns are used singly, or a plurality of such yarns are used as arranged in parallel.

Since the network of the basket goal net of this invention is formed on a Raschel netting machine by warp knitting, the junctions of each two adjacent cable cords of the network do not have large knots which are formed in the conventional net. As a result, the goal net remains almost free of abrasion no matter how many times the ball passes through the net. In fact, the net has remarkably improved abrasion resistance and outstanding durability.

Whereas the knots of the conventional net become tightened up and compacted to stretch their legs to a full extent, the net of this invention will not be fully stretched at the leg portions but retains the desired restoring properties at all times. Consequently every time the ball passes through the net, the ball is temporarily slowed down and, upon passage through the net, the net quickly restores itself to the original state by contraction, whatever number of times the ball may be thrown through the net. Thus the passage of the ball can be recognized with ease. When higher restoring properties are desirable, the number of courses at each junction, which is two in FIG. 2, may be increased to three as shown in FIG. 3.

Further because the basket goal net of this invention can be knitted by a Raschel netting machine, yarns as supplied by the spinner are usable. This greatly simplifies the manufacturing process, while the high productivity of the Raschel netting machine affords goal nets with an outstanding and uniform quality at a lower cost.

The conventional anti-whipping treatment with use of resin has already been described as a method of preventing the net from whipping up and twining about the ring owing to the reaction of the ball thrown through the net. However, the goal net of this invention has anti-whipping properties which are equivalent or superior to those imparted by the conventional treatment and which are given by ingeniously knitting the structure of the net on a Raschel netting machine without using any resin.

Figure 4:
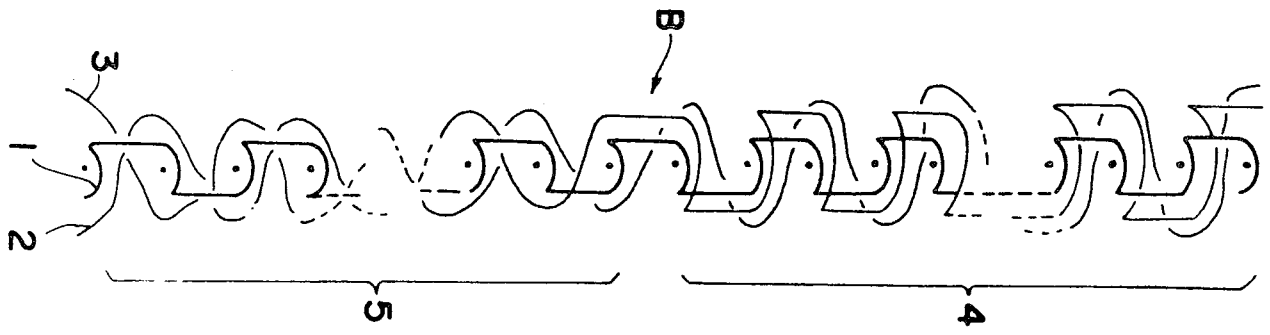
FIG. 4 is a diagram partly broken away and showing the structure of a modified embodiment of the invention.

FIG. 4 shows a modified embodiment having such an ingenious structure in which at least one of the inlay yarns 2, 3, as well as the chain yarn 1, provides loops at least in the upper half of each netting cord B. Stated more specifically, the inlay yarn 2 is formed with loops (by Raschel knitting) at a portion 4 which must be subjected to anti-whipping treatment and which extends from a portion 5 having no necessity of anti-whipping treatment, whereby the portion 4 of the netting cord, which must be subjected to anti-whipping treatment, is given an increased thickness and stiffness and is thereby hardened as is achieved by the treatment with resin. This substantially decreases the likelihood that the net will whip up to twine about the ring upon passage of the ball therethrough. In order to obtain sufficient anti-whipping properties, the netting cord must be processed for the anti-whipping properties at least over the upper half portion thereof. For the same reason as already stated, the processed portion of the netting cord should be 1.5 mm to 10 mm in thickness.

Although the goal net thus processed has higher anti-whipping properties than the conventional net treated with resin, it has been found that the net is still likely to whip and twine about the ring with the probability of 1–2 out of 1,000. We have found that this problem can be overcome by heat-treating the goal net having the ingenious warp-knitted structure described above. According to the present invention, therefore, the goal net so warp-knitted is treated with heat at 100° to 140° C. for 1 to 15 minutes with application of water vapor (steam), or with heat at 170° to 210° C. in dry air, to thermally shrink the portion 4 of every netting cord and thereby give greater stiffness thereto, whereby the desired anti-whipping properties are imparted to the goal net.

The heat treatment produces the same effect, whether it is conducted with or without application of steam, but the application of steam achieves higher heat efficiency and is accordingly economical. In this case, it is more advantageous to effect the heat treatment at 120° to 130° C. for 5 to 10 minutes with application of steam.

For a better understanding of the advantages of the present invention, examples are given below.

EXAMPLE 1

Multifilament yarns of polyester fiber, i.e. a 31,500-denier chain yarn 1, 10,500-denier inlay yarn 2 and a 18,000-denier inlay yarn 3, were used for composing each netting cord. These yarns were warp-knitted on a Raschel netting machine to prepare a basket goal net according to this invention which was formed of netting cords having a thickness of 4.0 mm.

For comparison, this goal net according to the invention and a conventional goal net knitted manually by forming sheet bends one after another were tested for abrasion resistance. Each specimen with a 2-kg weight attached to its lower portion was brought into contact with a rotary drum having a diameter of 15 cm, provided with a sheet of sandpaper No. AA-320 according to JIS standard attached to its outer periphery and rotating at 50 r.p.m. The specimen was removed from the drum after 500 or 1,000 turns of rotation, and the residual strength of the specimen was then measured. The strength retentivity (%) of the specimen was calculated based on the strength of the specimen before the test. The abrasion resistance of specimen was evaluated in terms of the strength retentivity thus obtained. Table 1 shows the results.

TABLE 1

| Specimen No. | Abrasion resistance (strength retentivity, %) Number of turns of drum 500 | 1000 |
|---|---|---|
| (Invention) | | |
| 1 | 96.0 | 81.2 |
| 2 | 92.1 | 80.3 |
| 3 | 97.1 | 76.5 |
| 4 | 95.4 | 76.2 |
| (Conventional) | | |
| 5 | 70.2 | 26.4 |
| 6 | 68.4 | 21.0 |

Table 1 reveals that the basket goal net of the present invention has exceedingly higher abrasion resistance (strength retentivity, %) and therefore more excellent properties than the conventional goal net.

EXAMPLE 2

The same yarns as used in Example 1 were knitted on a Raschel netting machine to prepare a goal net in which as seen in FIG. 4, each netting cord included a portion 5 having a thickness of 4.0 mm and subjected to no anti-whipping processing and a portion 4 having a thickness of 6.5 mm and loops of the inlay yarn 2 so as to exhibit anti-whipping properties.

For comparison two kinds of conventional goal nets were prepared, one treated with resin and thereby adapted to have anti-whipping properties and the other not treated with resin. The specimens of the former type will be referred to as "Conventional I" and those of the latter type as "Conventional II" in the present example and also in the examples to follow.

Each specimen was tested for abrasion resistance in the same manner as in Example 1, and also for stiffness by fixing a 10-cm length of the netting cord (portion 4 in the case of this invention) to a support at one end of the cord, with the other end thereof left free. The stiffness was evaluated in terms of the angle of inclination of the cord with respect to the horizontal. Table 2 shows the result.

TABLE 2

| Specimen No. | Abrasion resistance (strength retentivity, %) Number of turns of drum 500 | 1000 | Stiffness Angle (°) |
|---|---|---|---|
| (Invention) | | | |
| 1 | 96.1 | 80.5 | 3 |
| 2 | 95.2 | 81.4 | 3 |
| 3 | 94.7 | 82.3 | 4 |
| 4 | 92.5 | 78.2 | 3 |
| 5 | 94.7 | 79.6 | 2 |
| (Conventional I) | | | |
| 6 | 71.7 | 30.2 | 5 |
| 7 | 69.4 | 27.4 | 6 |
| (Conventional II) | | | |
| 8 | 70.4 | 27.3 | 81 |
| 9 | 68.1 | 26.9 | 84 |

Table 2 reveals that the basket goal net of the invention has higher abrasion resistance (strength retentivity), a smaller angle of inclination (i.e. higher stiffness) and therefore more excellent properties than the convention goal nets.

EXAMPLE 3

Substantially the same goal net as in Example 2 was prepared, with the junctions of the adjacent netting cords composed of three courses.

The goal net of the invention and conventional goal nets were tested for abrasion resistance and stiffness in exactly the same manner as in Example 2, except that the abrasion resistance was determined also at 1500 turns of rotation of the drum. Each specimen was further tested for restoring properties by attaching the net to a specified ring, passing a ball 100 times or 500 times from 1 m thereabove and thereafter measuring the diameter of the ball passing portion of the net upon the restoration of the net. The restoring properties were evaluated in terms of the ratio (%) of the diameter relative to the diameter of the ball. Table 3 shows the results.

TABLE 3

| Specimen No. | Abrasion resistance (strength retent'y, %) Drum turns 500 | 1000 | 1500 | Restoring properties (%) times 100 | 500 | Stiffness Angle (°) |
|---|---|---|---|---|---|---|
| (Invention) | | | | | | |
| 1 | 95.2 | 80.1 | 71.0 | 35.2 | 42.1 | 2 |
| 2 | 96.3 | 81.2 | 71.6 | 36.3 | 41.7 | 3 |
| 3 | 94.7 | 82.2 | 72.3 | 36.1 | 43.4 | 3 |
| 4 | 91.8 | 79.7 | 68.0 | 37.2 | 43.8 | 4 |
| 5 | 94.1 | 78.4 | 66.8 | 36.9 | 42.6 | 2 |
| (Conventional I) | | | | | | |
| 6 | 71.2 | 30.6 | 20.1 | 81.3 | 96.1 | 6 |
| 7 | 70.8 | 29.4 | 18.4 | 83.5 | 98.2 | 8 |
| (Conventional II) | | | | | | |
| 8 | 70.4 | 27.3 | 18.3 | 84.0 | 98.7 | 87 |
| 9 | 69.3 | 28.1 | 19.0 | 82.2 | 97.2 | 85 |

Table 3 shows that the goal net of the invention is superior to the conventional goal nets in any of the abrasion resistance, restoring properties and stiffness.

EXAMPLE 4

A goal net prepared in the same manner as in Example 2 according to the invention was heat-treated with application of steam for 5 minutes, using a steam setter at a temperature of 130° C. to compact the network and give higher stiffness to the net.

The goal net and conventional goal nets were tested for abrasion resistance and stiffness for comparision in exactly the same manner as in Example 2. Table 4 shows the results.

TABLE 4

| Specimen No. | Abrasion resistance (strength retentivity, %) Number of turns of drum 500 | 1000 | Stiffness Angle (°) |
|---|---|---|---|
| (Invention) | | | |
| 1 | 97.2 | 83.4 | 0 |
| 2 | 96.1 | 82.6 | 0 |
| 3 | 94.9 | 81.7 | 1 |
| 4 | 96.5 | 81.9 | 1 |
| (Conventional I) | | | |
| 5 | 68.4 | 31.4 | 6 |
| 6 | 70.2 | 30.9 | 7 |
| (Conventional II) | | | |
| 7 | 70.1 | 27.7 | 80 |
| 8 | 69.9 | 26.8 | 86 |

Table 4 shows that the goal net of the invention is superior to the conventional goal nets in abrasion resistance, stiffness and anti-whipping properties. The table further reveals that the net of the present example has higher stiffness than those of the other examples, the increment of the stiffness being afforded by the heat treatment.

What is claimed is:

1. A basket goal net having an open upper end adapted to be connected to a goal ring and an open lower end of a smaller opening characterized in that the net is formed from a plurality of netting cords of synthetic fiber, each of the netting cords comprising at least one main yarn having loops formed over the entire length thereof by warp knitting and at least one inlay yarn having loops formed simultaneously with the loops of the main yarn by warp knitting in the upper half of the netting cord to give that portion of the netting cord a greater thickness and stiffness than the remaining portion of the netting cord, each two adjacent netting cords being joined together at a plurality of locations by warp knitting.

2. A goal net as defined in claim 1, wherein the netting cords are made of polyester.

3. A goal net as defined in claim 1, wherein the netting cords are made of polyamide.

4. A goal net as defined in claim 1, wherein the netting cords are made of polyethylene.

5. A goal net as defined in claim 1, wherein the netting cords are made of polypropylene.

6. A goal net as defined in claim 1, wherein the netting cords have a thickness of 1.5 mm to 10 mm.

7. A goal net as defined in claim 1, wherein the junctions of the adjacent netting cords include at least two courses.

8. A goal net as defined in claim 1, wherein the meshes of the net have a honeycomb shape.

* * * * *